US010210797B2

(12) United States Patent
Lee et al.

(10) Patent No.: US 10,210,797 B2
(45) Date of Patent: Feb. 19, 2019

(54) METHOD OF AGING ORGANIC LIGHT EMITTING DISPLAY DEVICE

(71) Applicant: SAMSUNG DISPLAY CO., LTD., Yongin-si, Gyeonggi-do (KR)

(72) Inventors: Seong Min Lee, Yongin-si (KR); Hyo Min Kim, Yongin-si (KR); Chi Yeoung Shim, Yongin-si (KR); Ju Kyung Jo, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 46 days.

(21) Appl. No.: 15/162,719

(22) Filed: May 24, 2016

(65) Prior Publication Data

US 2017/0069261 A1 Mar. 9, 2017

(30) Foreign Application Priority Data

Sep. 7, 2015 (KR) ..... 10-2015-0126467

(51) Int. Cl.

| | |
|---|---|
| ***G09G 3/3208*** | (2016.01) |
| ***G09G 5/02*** | (2006.01) |
| ***G09G 5/10*** | (2006.01) |

(52) U.S. Cl.

CPC ..... *G09G 3/3208* (2013.01); *G09G 5/02* (2013.01); *G09G 5/10* (2013.01); *G09G 2320/043* (2013.01); *G09G 2320/0626* (2013.01); *G09G 2320/0666* (2013.01)

(58) Field of Classification Search

CPC ..... G09G 3/3208; G09G 5/02; G09G 5/10; G09G 2320/0626; G09G 2320/043; G09G 2320/0666

See application file for complete search history.

(56) References Cited

U.S. PATENT DOCUMENTS

2002/0123291 A1* 9/2002 Miyashita ..... H01L 51/56 445/3
2006/0077136 A1* 4/2006 Cok ..... G09G 3/3216 345/76

FOREIGN PATENT DOCUMENTS

KR 10-2008-0060880 A 7/2008

* cited by examiner

*Primary Examiner* — Amr Awad
*Assistant Examiner* — Andre Matthews
(74) *Attorney, Agent, or Firm* — Lee & Morse, P.C.

(57) ABSTRACT

A method for aging an organic light emitting display includes estimating a lifespan curve of a display panel based on at least one initial aging profile of the display panel, correcting at least one of a target luminance or a target white color coordinates of the display panel such that the estimated lifespan curve corresponds to a target lifespan curve, and setting a lifespan look up table by storing at least one of the correction value of the target luminance or the correction value of the target white color coordinates.

15 Claims, 5 Drawing Sheets

METHOD OF AGING ORGANIC LIGHT EMITTING DISPLAY DEVICE

CROSS-REFERENCE TO RELATED APPLICATION

Korean Patent Application No. 10-2015-0126467, filed on Sep. 7, 2015, and entitled, "Method of Aging Organic Light Emitting Display Device," is incorporated by reference herein in its entirety.

BACKGROUND

1. Field

One or more embodiments described herein relate to a method of aging an organic light emitting display device.

2. Description of the Related Art

An organic light emitting display (OLED) device may employ a resonance structure that includes a self-luminous organic phosphor. The characteristics of this and/or other materials in the OLED may degrade. As a result, luminance may decrease over time. Thus, one way of measuring the lifespan of an OLED is to determine the amount of luminance reduction that has taken place.

In addition to these effects, since the luminance reduction speeds of R, G, and B subpixels of a panel are different, the color coordinates of white light may change the more the panel is used. The consequent reduction in luminance and color change may be displayed as a residual image.

In an attempt to solve these problems, efforts have been made to develop new materials for enhancing the lifespan of an OLED. However, the development of new materials is cost and time inefficient.

SUMMARY

In accordance with one or more embodiments, a method for aging an organic light emitting display, the method comprising: estimating a lifespan curve of a display panel based on at least one initial aging profile of the display panel; correcting at least one of a target luminance or a target white color coordinates of the display panel such that the estimated lifespan curve corresponds to a target lifespan curve; and setting a lifespan look up table (LUT) by storing at least one of the correction value of the target luminance or the correction value of the target white color coordinates.

Estimating the lifespan curve may include estimating a lifespan of the display panel using at least one of a reduction slope of a lifespan curve during a certain initial period of time in the at least one initial aging profile, a reduction slope of a lifespan curve during a certain latter period of time in the at least one initial aging profile, or a luminance acceleration factor as a unique value of an organic light emitting material of the display panel.

Estimating the lifespan curve may include estimating the lifespan curve based on Equation 1:

$$L = \exp\left(-a\left(t \times \left(\frac{i}{i_{std}}\right)^{acc}\right)^{b}\right)$$

wherein L denotes a lifespan ratio as a first axis of the lifespan curve, t denotes a time as a second axis of the lifespan curve, a denotes a reduction slope of the lifespan curve during a certain initial period of time in the at least one initial aging profile, b denotes a reduction slope during a certain latter period of time in the at least one initial aging profile, acc denotes a luminance acceleration factor as a unique value of an organic light emitting material of the display panel, $i_{std}$ denotes a reference current value for determining sensitivity regarding a current, and i denotes a current value.

Correcting at least one of the target luminance or the target white color coordinates may includes calculating a luminance correction value of the target luminance for making the estimated lifespan curve substantially equal to a mean time to failure (MTTF); and correcting the target luminance according to the calculated correction value of the target luminance.

Setting the lifespan LUT may include recording the correction value of the target luminance and the correction value of the target white color coordinates, respectively corresponding to at least one target luminance obtained through aging on a plurality of display panels, in the lifespan LUT in an accumulating manner.

Setting the lifespan LUT may include setting the lifespan LUT including at least one of a model name of the display panel, at least one target luminance, at least one initial aging profile, a correction value of the target luminance corresponding to each of the at least one target luminance, a correction value of the target white color coordinates corresponding to each of the at least one target luminance, a driving time corresponding to the at least one target luminance, and a B10 lifespan corresponding to each of the at least one target luminance.

The method may include obtaining the target luminance and the at least one initial aging profile of a display panel to be aged; searching for at least one of a correction value of the target luminance or a correction value of the white color coordinates corresponding to the obtained target luminance or the obtained at least one initial aging profile from the lifespan LUT; and correcting at least one of the target luminance or the target white color coordinates of the display panel to be aged using at least one of the searched correction value of the target luminance and the searched correction value of the white color coordinates.

In accordance with one or more other embodiments, a method for aging an organic light emitting display includes obtaining a target luminance or at least one aging profile of a display panel to be aged; searching for at least one of a correction value of a target luminance or a correction value of white color coordinates corresponding to the obtained target luminance or the obtained at least one initial aging profile from a preset lifespan look up table (LUT); and correcting at least one of the target luminance or the target white color coordinates of the display panel to be aged using at least one of the searched correction value of the target luminance or the searched correction value of the white color coordinates.

The method may include setting the lifespan LUT using the correction value of the target luminance and the correction value of the target white color coordinates respectively corresponding to the at least one target luminance.

Setting the lifespan LUT may include recording the correction value of the target luminance and the correction value of the target white color coordinates respectively corresponding to at least one target luminance obtained through aging on a plurality of display panels in the lifespan LUT in an accumulating manner. Setting the lifespan LUT may include setting the lifespan LUT including at least one of a model name of the display panel, at least one target luminance, at least one initial aging profile, a correction value of the target luminance corresponding to each of the at least one target luminance, a correction value of the target white color coordinates corresponding to each of the at least one target luminance, a driving time corresponding to the at least one target luminance, or a B10 lifespan corresponding to each of the at least one target luminance.

In accordance with one or more other embodiments, a method for aging an organic light emitting display includes estimating a lifespan curve of a display panel based on at least one aging profile of the display panel; correcting at least one parameter to reduce a difference between the estimated lifespan curve and a target lifespan curve; and aging the display panel based on the corrected at least one parameter. The at least one parameter may be a target luminance or target white color coordinates of the display panel.

Estimating the lifespan curve may include estimating a lifespan of the display panel using at least one of a reduction slope of a lifespan curve during a certain initial period of time in the at least one aging profile, a reduction slope of a lifespan curve during a certain latter period of time in the at least one aging profile, or a luminance acceleration factor as a unique value of an organic light emitting material of the display panel. The method may include storing the corrected at least one parameter in a lifespan look up table. Storing the corrected at least one parameter may include recording the corrected at least one parameter in the lifespan lookup table in an accumulating manner.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
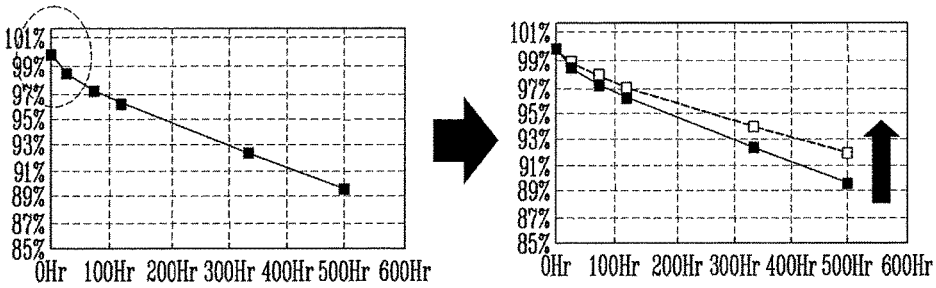
FIG. 1 illustrates an example of aging that may take place in an OLED.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
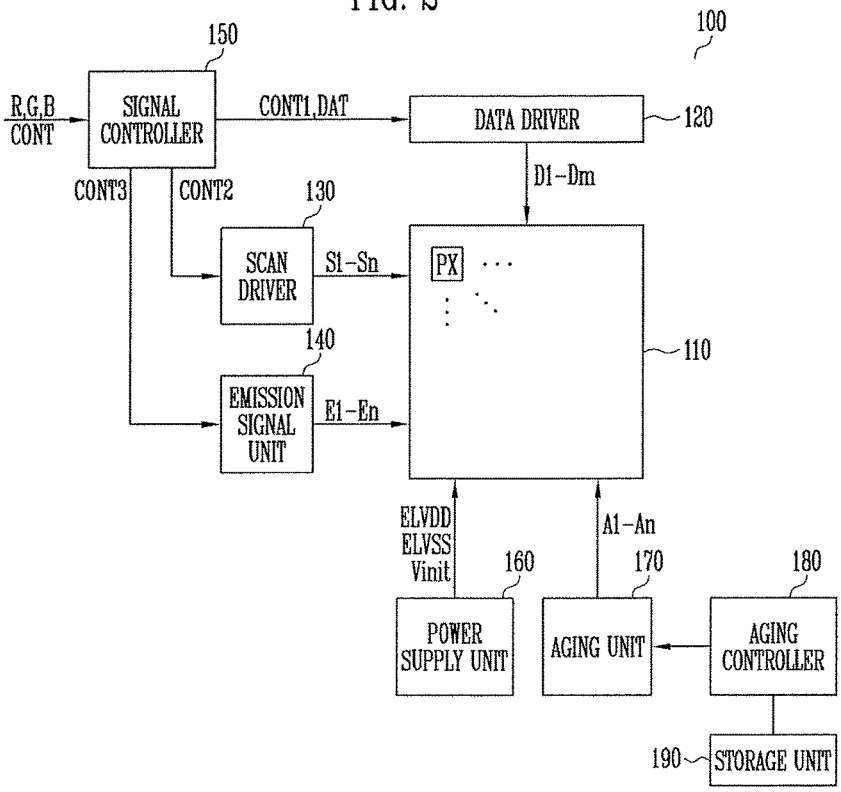
FIG. 2 illustrates an embodiment of an organic light emitting display.

FIG. 2 illustrates an organic light emitting display 100 according to one embodiment. The organic light emitting display 100 includes a display panel 110, a data driver 120, a scan driver 130, and an emission signal unit 140 connected to the display panel 110, and a signal controller 150 for controlling the aforementioned features. The organic light emitting display 100 also includes a power supply unit 160 connected to the display panel 110, an aging unit 170, an aging controller 180 controlling the aging unit 170, and a storage unit 190.

The display panel 110 includes a plurality of scan signal lines S1 to Sn, a plurality of emission signal lines E1 to En, a plurality of data lines D1 to Dm, a plurality of aging lines A1 to Am, and a plurality of pixels PX connected to these elements and arranged in a matrix form. In an exemplary embodiment, the scan signal lines S1 to Sn may be arranged in a row direction and the data lines D1 to Dm and the aging lines A1 to Am may be arranged in a column direction or a row direction.

The data driver 120 is connected to the data lines D1 to Dm of the display panel 110 and applies a data voltage corresponding to an image signal to data lines D1 to Dm.

The scan driver 130 is connected to the scan signal lines S1 to Sn of the display panel 110 and applies a scan signal to the scan signal line S1 to Sn.

The emission signal unit 140 is connected to the emission signal lines E1 to En of the display panel 110, and applies an emission signal for controlling an emission time to the emission signal lines E1 to En. The emission signal may be a sequential emission signal or a simultaneously emission signal according to designs.

The signal controller 150 controls the data driver 120, the scan driver 130, and the emission signal unit 140. The signal controller 150 receives video signals R, G, and B, and one or more control signals CONT, e.g., a horizontal synchronization signal Hsync, a vertical synchronization signal Vsync, a clock signal CLK, and/or a data enable signal DE. The signal controller 150 processes the video signals R, G, and B appropriately to fit an operation condition of the display on the basis of the control signal CONT, and generates and outputs a video data DAT, a scan control signal CONT1, a data control signal CONT2, an emission control signal CONT3, and a clock signal CLK.

The power supply unit 160 may include a first power source supplying a source voltage ELVDD to the pixels, a second power source supplying a reference voltage ELVSS, and a third power source supplying an initialization voltage Vinit.

The aging unit 170 is connected and applies an aging signal to the aging lines A1 to Am. The aging unit 170 may include an aging signal supply unit for generating an aging signal. In at least one embodiment, aging may refer to emitting the OLED for a predetermined period of time in order to accelerate a reduction in initial luminance of the OLED.

When the aging signal is applied, the OLED of the pixel emits light by a current of the aging signal. The aging signal may be a pulse signal (or an aging pulse) in the form of alternating current (AC). The aging unit 170 may further include a probe for supplying a pulse signal to the pixels and a switch. The pulse signal may be selected to have minimum (for example, −25V) to maximum (for example, 25V) voltage levels. When the pulse signal is outside of the maximum or minimum voltage level, the OLED may be damaged. However, the voltage level of the pulse signal may be varied according to thickness, or the like, of the OLED. Thus, the voltage level of the pulse signal may vary in different embodiments. Also, the aging signal may be a DC voltage in at least one embodiment.

The aging controller 180 may control the aging unit 170 to perform initial aging, and may estimate a lifespan curve on the basis of an aging profile obtained at the initial aging of the display panel 110. The aging controller 180 may correct at least one of a target luminance and target white color coordinates of the display panel 110 on the basis of the estimated lifespan curve, and store the luminance correction value or the color coordinate correction value as a look up table (LUT).

Also, the aging controller 180 may search a luminance correction value and/or white color coordinate correction value corresponding to the target luminance of the display panel 110 from the lifespan LUT. Additionally, the aging controller 180 may control the aging unit 170 to perform initial aging, search a luminance correction value and/or white color coordinate correction value corresponding to the aging profile obtained at the initial aging from the lifespan LUT, and correct the target luminance and/or target white color coordinates using the searched luminance correction value and/or the white color coordinate correction value.

The storage unit 190 stores information required for aging under the control of the aging controller 180. In one embodiment, the storage unit 190 may store the lifespan look up table. The lifespan look up table may include, for example, at least one of a model name, a target luminance, or an initial aging profile. Also, the lifespan look up table may include at least one of a luminance correction value or a white color coordinate correction value corresponding to the target luminance or the initial aging profile. Also, the lifespan look up table may include a driving time (lifespan) and B10 lifespan.

Figure 3:
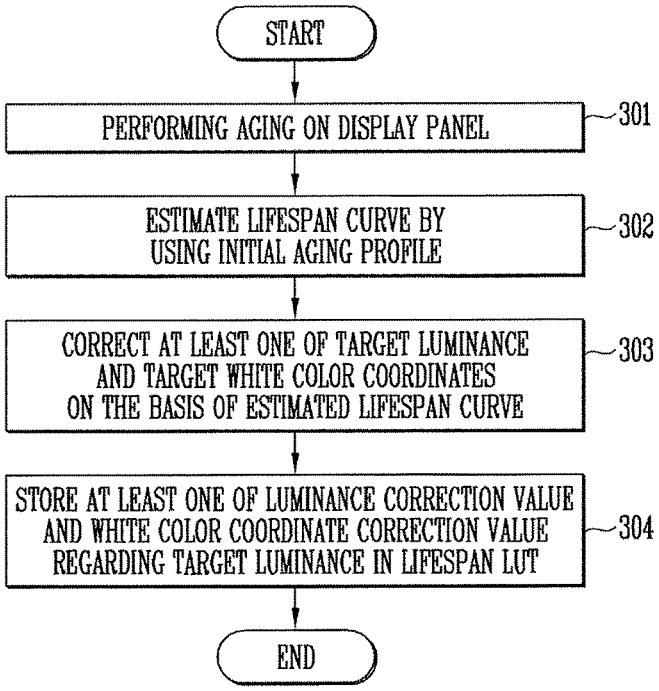
FIG. 3 illustrates an embodiment of a method for storing a lifespan look-up table to perform aging.

FIG. 3 illustrates an embodiment of a method for storing a lifespan look-up table to perform aging. Referring to FIG. 3, first, the aging controller 180 performs aging on the display panel 110 in operation 301. The aging, which may be aging in a model/cell state, may include an operation of enabling the organic light emitting display device to emit light for a predetermined period of time so as to be degraded on purpose.

Thereafter, the aging controller 180 estimates (models) a lifespan curve using an initial aging profile obtained during the aging in operation 302. The initial aging profile may refer to a luminance value at a certain initial aging time point. In the present embodiment, a lifespan curve may be estimated from a luminance value at the certain initial aging time point using the fact that a lifespan reduction ratio of the display panel 110 follows a luminance reduction ratio.

The lifespan curve may be estimated, for example, based on Equation 1.

$$L = \exp\left(-a\left(t \times \left(\frac{i}{i_{std}}\right)^{acc}\right)^{b}\right) \quad (1)$$

In Equation 1, L denotes a lifespan ratio, t denotes a time, a denotes a reduction slope of the lifespan curve during a certain initial period of time in the initial aging profile, and b denotes a reduction slope during a certain latter period of time in the initial aging profile.

The certain latter period of time for determining b may be a period of time excluding the certain initial period of time for determining a in the initial aging performing period of time. The term Acc denotes a luminance acceleration factor as a value indicating sensitivity (stress) with respect to a current of the display panel 110, which is a unique value of an organic light emitting material obtained when the organic light emitting material is obtained. The term $I_{std}$ denotes a reference current value for determining sensitivity regarding a current, and i denotes a current value.

Figure 4:
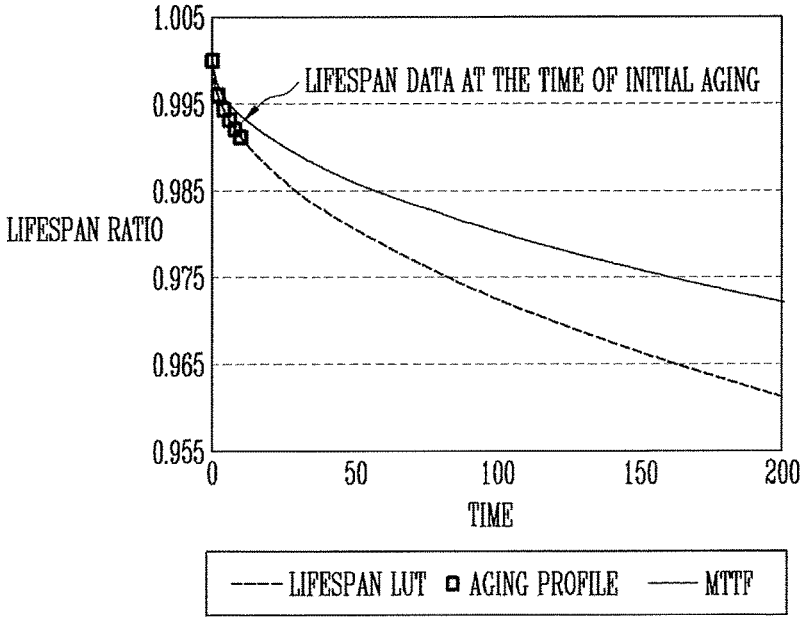
FIG. 4 illustrates an example of luminance correction.

FIG. 4 illustrates an example of the lifespan curve estimated by Equation 1.

Thereafter, the aging controller 180 corrects at least one of the target luminance and the target white color coordinates on the basis of the estimated lifespan curve in operation 303.

As illustrated in FIG. 4, the aging controller 180 calculates a luminance correction value (an increase or decrease value) for the estimated lifespan curve to be equal to a mean time to failure (MTTF). In one embodiment, the aging controller 180 may calculate the difference between the estimated lifespan curve and the MTTF using the luminance acceleration factor. The aging controller 180 may correct the target luminance of the display panel 110 using the calculated luminance correction value.

Figure 5:
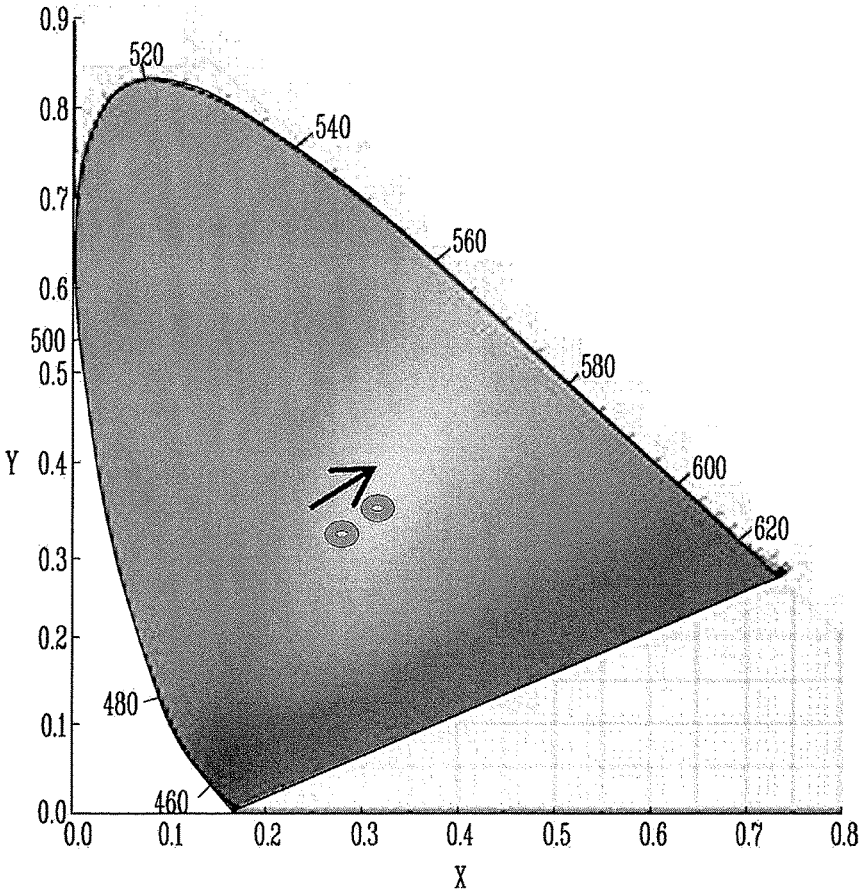
FIG. 5 illustrates an example of white color coordinate correction.

The aging controller 180 calculates a correction value of the white color coordinates for the estimated lifespan curve to be equal to the MTTF. As illustrated in FIG. 5, the aging controller 180 may correct the target white color coordinates of the display panel 110 using the calculated correction value of the white color coordinates.

Thereafter, in operation 304, the aging controller 180 stores at least one of the luminance correction value regarding the target luminance and the white color coordinate correction value in the lifespan look up table.

The lifespan look up table may be a data table for accumulatively recording the luminance correction value and/or the white color coordinate correction value calculated according to the target luminance in performing aging in accordance with aging method embodiments herein. The lifespan look up table may include, for example, at least one of a model name, a target luminance, or an initial aging profile of the display panel 110. The display panel 110 may be different based on the manufacturing method used and/or the model of the display panel. As a result, the characteristics of the panel (e.g., initial aging profile or the like) may be different. Thus, it is appropriate to apply the lifespan look up table to only a matching model. Accordingly the lifespan look up table according to one embodiment may include information indicative of the model name.

Also, the lifespan look up table may include at least one of a luminance correction value or a white color coordinate correction value corresponding to a target luminance or an initial aging profile. In addition, the lifespan look up table may include a driving time (lifespan) and B10 lifespan corresponding to the target luminance or the initial aging profile.

When the lifespan look up table includes the luminance correction value corresponding to the target luminance, the lifespan look up table may be formed, for example, as set forth in Table 1.

TABLE 1

| Model | Target Luminance | Luminance Correction Value |
|---|---|---|
| 4.99QS | 300 | −50 |
| | 310 | −40 |
| | 320 | −30 |
| | 330 | −20 |
| | 340 | −10 |
| | 350 | 0 |
| | 360 | 10 |
| | 370 | 20 |
| | 380 | 30 |
| | 390 | 40 |
| | 400 | 50 |

Figure 6:
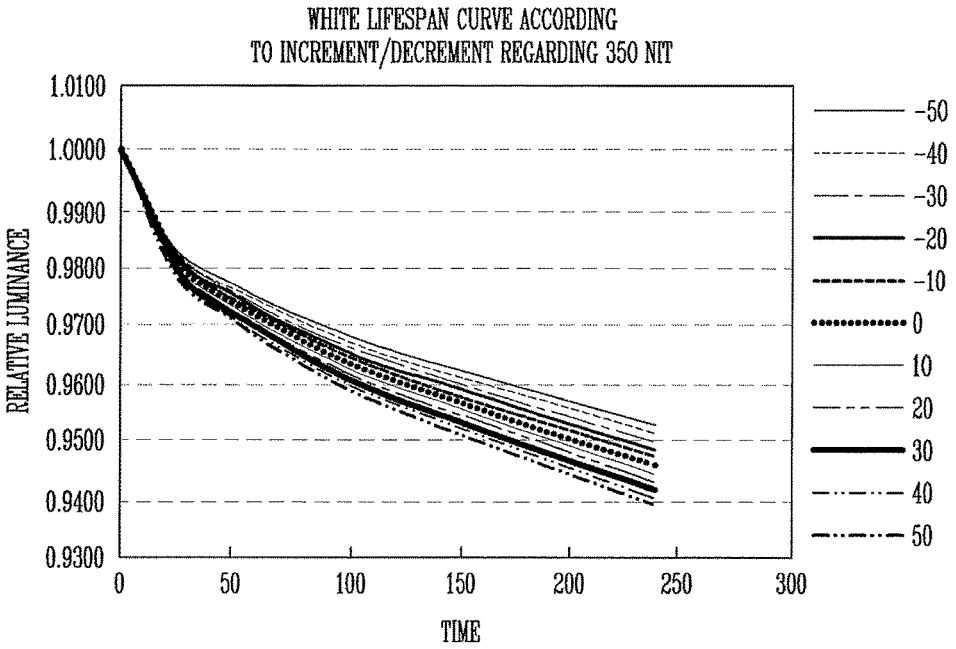
FIG. 6 illustrates an example of a lifespan curve.

FIG. 6 illustrates an example of a lifespan curve according to a luminance correction value regarding a luminance of 350 nit. Referring to FIG. 6, the lifespan of the display panel 110 may be shortened by increasing luminance with reference to the lifespan look up table, or the lifespan of the display panel 110 may be lengthened by reducing luminance.

Alternatively, when the lifespan look up table includes a white color coordinate correction value corresponding to the target luminance, the lifespan look up table may be formed, for example, as set forth in Table 2.

TABLE 2

| | | White color coordinate correction value | |
|---|---|---|---|
| Model | Target luminance | Wx | Wy |
| 4.99QS | 300 | 0.294 | 0.314 |
| | 310 | 0.295 | 0.315 |
| | 320 | 0.296 | 0.316 |

TABLE 2-continued

| | | White color coordinate correction value | |
|---|---|---|---|
| Model | Target luminance | Wx | Wy |
| | 330 | 0.297 | 0.317 |
| | 340 | 0.298 | 0.318 |
| | 350 | 0.299 | 0.319 |
| | 360 | 0.3 | 0.32 |
| | 370 | 0.301 | 0.321 |
| | 380 | 0.302 | 0.322 |
| | 390 | 0.303 | 0.323 |
| | 400 | 0.304 | 0.324 |

In one embodiment of the present invention, the lifespan look up table may include all of luminance correction values and white color coordinate correction values. In this case, the lifespan look up table may be formed, for example, as in Table 3.

TABLE 3

| | Target | Luminance correction | White color coordinate correction value | |
|---|---|---|---|---|
| Model | luminance | value | Wx | Wy |
| 4.99QS | 300 | −50 | 0.298 | 0.318 |
| | 310 | −40 | 0.298 | 0.318 |
| | 320 | −30 | 0.298 | 0.318 |
| | 330 | −20 | 0.298 | 0.318 |
| | 340 | −10 | 0.298 | 0.318 |
| | 350 | 0 | 0.298 | 0.318 |
| | 360 | 10 | 0.298 | 0.318 |
| | 370 | 20 | 0.298 | 0.318 |
| | 380 | 30 | 0.298 | 0.318 |
| | 390 | 40 | 0.298 | 0.318 |
| | 400 | 50 | 0.298 | 0.318 |

In one embodiment, the lifespan look up table may include a driving time (lifespan) and B10 lifespan corresponding to the target luminance or the initial aging profile. In this case, the lifespan look up table may be formed, for example, as set forth in Table 4 or Table 5.

| | Target | Luminance correction | White color coordinate correction value | | Driving | B10 | |
|---|---|---|---|---|---|---|---|
| Model | luminance | value | Wx | Wy | time | ΔL_w | Δu'v'_w' |
| 4.99QS | 300 | −50 | 0.298 | 0.318 | 240 | 0.9527 | 0.0014 |
| | 310 | −40 | 0.298 | 0.318 | 240 | 0.9513 | 0.0016 |
| | 320 | −30 | 0.298 | 0.318 | 240 | 0.9499 | 0.0018 |
| | 330 | −20 | 0.298 | 0.318 | 240 | 0.9485 | 0.0020 |
| | 340 | −10 | 0.298 | 0.318 | 240 | 0.9471 | 0.0022 |
| | 350 | 0 | 0.298 | 0.318 | 240 | 0.9457 | 0.0025 |
| | 360 | 10 | 0.298 | 0.318 | 240 | 0.9443 | 0.0027 |
| | 370 | 20 | 0.298 | 0.318 | 240 | 0.9430 | 0.0029 |
| | 380 | 30 | 0.298 | 0.318 | 240 | 0.9416 | 0.0031 |
| | 390 | 40 | 0.298 | 0.318 | 240 | 0.9402 | 0.0034 |
| | 400 | 50 | 0.298 | 0.318 | 240 | 0.9388 | 0.0036 |

| Model | Target luminance | White color coordinate correction value Wx | Wy | Driving Time | B10 ΔL_w | Δu'v'_w' |
|---|---|---|---|---|---|---|
| 4.99QS | 300 | 0.294 | 0.314 | 240 | 0.9454 | 0.0029 |
| | 310 | 0.295 | 0.315 | 240 | 0.9455 | 0.0028 |
| | 320 | 0.296 | 0.316 | 240 | 0.9455 | 0.0027 |
| | 330 | 0.297 | 0.317 | 240 | 0.9456 | 0.0026 |
| | 340 | 0.298 | 0.318 | 240 | 0.9457 | 0.0025 |
| | 350 | 0.299 | 0.319 | 240 | 0.9458 | 0.0024 |
| | 360 | 0.3 | 0.32 | 240 | 0.9459 | 0.0022 |
| | 370 | 0.301 | 0.321 | 240 | 0.9460 | 0.0021 |
| | 380 | 0.302 | 0.322 | 240 | 0.9460 | 0.0020 |
| | 390 | 0.303 | 0.323 | 240 | 0.9461 | 0.0019 |
| | 400 | 0.304 | 0.324 | 240 | 0.9462 | 0.0018 |

In Table 4 and Table 5, B10 lifespan is a value of lower 10% of lifespan distribution and ΔL_w denotes a white luminance variation and Δu'v'_w' denotes a color variation.

When the lifespan look up table records sufficient data through aging of a plurality of display panels 110, the aging controller 180 may search for luminance correction value and/or white color coordinate correction value corresponding to the target luminance from the lifespan look up table and correct the luminance and/or white color coordinates with a corresponding value. Alternatively, the aging controller 180 may perform only initial aging, instead of entire aging, and search for a luminance correction value and/or white color coordinate correction value corresponding to the initial aging profile and correct the luminance and/or white color coordinates with the corresponding value.

Figure 7:
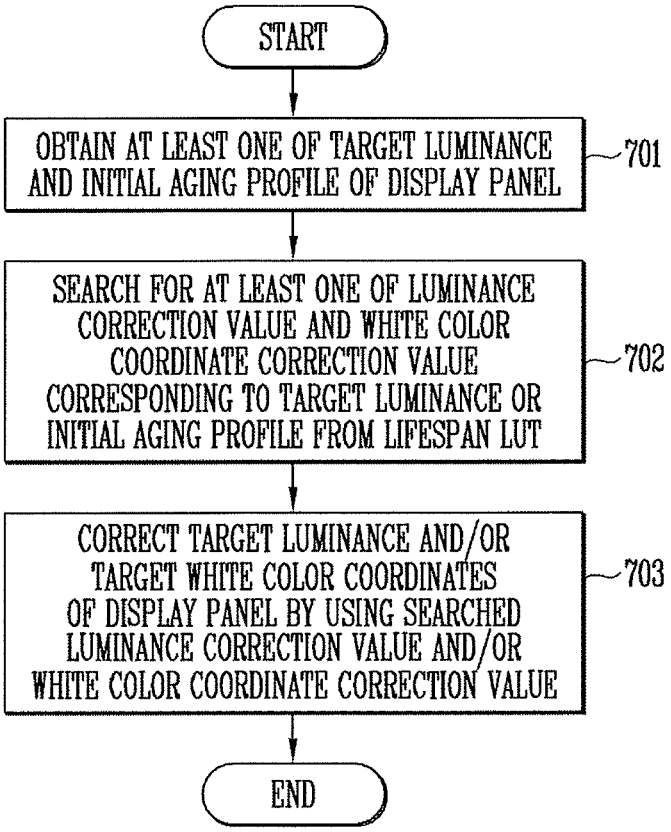
FIG. 7 illustrates an embodiment of an aging method.

FIG. 7 illustrates another embodiment of an aging method. In this embodiment, the aging controller 180 may effectively perform aging using a previously stored lifespan look up table.

Referring to FIG. 7, the aging controller 180 obtains at least one of a target luminance or an initial aging profile of the display panel 110 (operation 701). When the aging controller 180 intends to obtain the initial aging profile, the aging controller 180 may perform aging during a certain initial period of time.

After the target luminance or initial aging profile is obtained, the aging controller 180 searches for at least one of a luminance correction value or a white color coordinate correction value corresponding to the obtained target luminance or initial aging profile from the lifespan look up table (operation 702).

Thereafter, the aging controller 180 corrects the target luminance and/or target white color coordinates of the display panel 110 using the searched luminance correction value and/or white color coordinate correction value (operation 703).

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controller, aging unit, and other processing features of the embodiments described herein may be implemented in logic which, for example, may include hardware, software, or both. When implemented at least partially in hardware, the controller, aging unit, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controller, aging unit, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, an organic light emitting display (OLED) device may employ a resonance structure that includes a self-luminous organic phosphor. The characteristics this and/or other materials in the OLED may degrade. As a result, luminance may reduce over time. Thus, one way of measuring the lifespan of an OLED is to determine the amount of luminance reduction that has taken place.

In addition to these effects, since the luminance reduction speeds of R, G, and B subpixels of a panel are different, the color coordinates of white light may change the more the panel is used. The consequent reduction in luminance and color change may be displayed as a residual image.

In an attempt to solve these problems, efforts have been made to develop new materials for enhancing the lifespan of an OLED. However, the development of new materials is cost and time inefficient.

Another way of attempting to solve this problem involves employing an aging method that accelerates the initial reduction in luminance. Such an approach involves enabling the OLED to emit light for a predetermined period of time in a full screen state. This is usually performed during the manufacturing process. As illustrated in FIG. 1, the aging method involves removing an initial luminance reduction portion by forcibly degrading the OLED. After the initial luminance is removed, display of the OLED is set to a target luminance according to product specifications and products are then sold to the public.

This aging method may slightly enhance the lifespan of an OLED, but the increased lifespan is merely a few minutes. Also, the aging method may maintain the lifespan distribution of panels as is.

In accordance with one or more of the aforementioned embodiments, a method of aging an organic light emitting display device improves the lifespan of a display panel and its lifespan distribution. The method performs aging in a cell or module state, estimates a medium and long-term lifespan reduction tendency uses an initial aging profile, and corrects at least one of luminance and white color coordinates such that a lifespan curve appearing in the estimated lifespan reduction tendency is identical to an average curve.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the following claims.

What is claimed is:

1. A method for aging an organic light emitting display, the method comprising:

estimating a lifespan curve of a display panel based on at least one initial aging profile of the display panel and a luminance acceleration factor indicative of sensitivity with respect to a current of the display panel;

correcting at least one of a target luminance or target white color coordinates of the display panel such that the estimated lifespan curve corresponds to a target lifespan curve; and setting a lifespan look up table (LUT) by storing at least one of a correction value of the target luminance or a correction value of the target white color coordinates, wherein estimating the lifespan curve includes estimating the lifespan curve based on Equation 1:

$$L = \exp\left(-a\left(t \times \left(\frac{i}{i_{std}}\right)^{acc}\right)^{b}\right)$$

wherein L denotes a lifespan ratio as a first axis of the lifespan curve, t denotes a time as a second axis of the lifespan curve, a denotes a reduction slope of the lifespan curve during a certain initial period of time in the at least one initial aging profile, b denotes a reduction slope during a certain latter period of time in the at least one initial aging profile, acc denotes the luminance acceleration factor, $i_{std}$ denotes a reference current value for determining sensitivity regarding a current, and i denotes a current value.

2. The method as claimed in claim 1, wherein estimating the lifespan curve includes estimating a lifespan of the display panel using at least one of the reduction slope of a lifespan curve during the certain initial period of time in the at least one initial aging profile or the reduction slope of a lifespan curve during the certain latter period of time in the at least one initial aging profile.

3. The method as claimed in claim 1, wherein correcting at least one of the target luminance or the target white color coordinates includes:

calculating a luminance correction value of the target luminance for making the estimated lifespan curve substantially equal to a mean time to failure (MTTF); and correcting the target luminance according to the calculated correction value of the target luminance.

4. The method as claimed in claim 1, wherein setting the lifespan LUT includes recording the correction value of the target luminance and the correction value of the target white color coordinates, respectively corresponding to at least one target luminance obtained through aging on a plurality of display panels, in the lifespan LUT in an accumulating manner.

5. The method as claimed in claim 1, wherein setting the lifespan LUT includes:

setting the lifespan LUT including at least one of a model name of the display panel, at least one target luminance, at least one initial aging profile, a correction value of the target luminance corresponding to each of the at least one target luminance, a correction value of the target white color coordinates corresponding to each of the at least one target luminance, a driving time corresponding to the at least one target luminance, and a B10 lifespan corresponding to each of the at least one target luminance.

6. The method as claimed in claim 1, further comprising:

obtaining the target luminance and the at least one initial aging profile of a display panel to be aged;

searching for at least one of a correction value of the target luminance or a correction value of the white color coordinates corresponding to the obtained target luminance or the obtained at least one initial aging profile from the lifespan LUT; and correcting at least one of the target luminance or the target white color coordinates of the display panel to be aged using at least one of the searched correction value of the target luminance and the searched correction value of the white color coordinates.

7. A method for aging an organic light emitting display, the method comprising:

obtaining a target luminance or at least one aging profile of a display panel to be aged based on estimating a lifespan curve of a display panel based on at least one initial aging profile of the display panel and a luminance acceleration factor indicative of sensitivity with respect to a current of the display panel;

searching for at least one of a correction value of a target luminance or a correction value of white color coordinates corresponding to the obtained target luminance or the obtained at least one initial aging profile from a preset lifespan look up table (LUT); and correcting at least one of the target luminance or the target white color coordinates of the display panel to be aged using at least one of the searched correction value of the target luminance or the searched correction value of the white color coordinates, wherein estimating the lifespan curve includes estimating the lifespan curve based on Equation 1:

$$L = \exp\left(-a\left(t \times \left(\frac{i}{i_{std}}\right)^{acc}\right)^{b}\right)$$

wherein L denotes a lifespan ratio as a first axis of the lifespan curve, t denotes a time as a second axis of the lifespan curve, a denotes a reduction slope of the lifespan curve during a certain initial period of time in the at least one initial aging profile, b denotes a reduction slope during a certain latter period of time in the at least one initial aging profile, acc denotes the luminance acceleration factor, $i_{std}$ denotes a reference current value for determining sensitivity regarding a current, and i denotes a current value.

8. The method as claimed in claim 7, further comprising:

setting the lifespan LUT using the correction value of the target luminance and the correction value of the target white color coordinates respectively corresponding to the at least one target luminance.

9. The method as claimed in claim 8, wherein setting the lifespan LUT includes:

recording the correction value of the target luminance and the correction value of the target white color coordinates respectively corresponding to at least one target luminance obtained through aging on a plurality of display panels in the lifespan LUT in an accumulating manner.

10. The method as claimed in claim 8, wherein setting the lifespan LUT includes:

setting the lifespan LUT including at least one of a model name of the display panel, at least one target luminance, at least one initial aging profile, a correction value of the target luminance corresponding to each of the at least one target luminance, a correction value of the target white color coordinates corresponding to each of the at least one target luminance, a driving time corresponding to the at least one target luminance, or a B10 lifespan corresponding to each of the at least one target luminance.

11. A method for aging an organic light emitting display, the method comprising:

estimating a lifespan curve of a display panel based on at least one aging profile of the display panel and a luminance acceleration factor indicative of sensitivity with respect to a current of the display panel;

correcting at least one parameter to reduce a difference between the estimated lifespan curve and a target lifespan curve; and aging the display panel based on the corrected at least one parameter, wherein estimating the lifespan curve includes estimating the lifespan curve based on Equation 1:

$$L = \exp\left(-a\left(t \times \left(\frac{i}{i_{std}}\right)^{acc}\right)^{b}\right)$$

wherein L denotes a lifespan ratio as a first axis of the lifespan curve, t denotes a time as a second axis of the lifespan curve, a denotes a reduction slope of the lifespan curve during a certain initial period of time in the at least one initial aging profile, b denotes a reduction slope during a certain latter period of time in the at least one initial aging profile, acc denotes the luminance acceleration factor, $i_{std}$ denotes a reference current value for determining sensitivity regarding a current, and i denotes a current value.

12. The method as claimed in claim 11, wherein the at least one parameter is a target luminance or target white color coordinates of the display panel.

13. The method as claimed in claim 11, wherein estimating the lifespan curve includes estimating a lifespan of the display panel using at least one of the reduction slope of the lifespan curve during a certain initial period of time in the at least one aging profile or the reduction slope of the lifespan curve during a certain latter period of time in the at least one aging profile.

14. The method as claimed in claim 11, further comprising:

storing the corrected at least one parameter in a lifespan look up table.

15. The method as claimed in claim 14, wherein storing the corrected at least one parameter includes:

recording the corrected at least one parameter in the lifespan look up table in an accumulating manner.

* * * * *